US007751530B2

(12) United States Patent
Sridhar et al.

(10) Patent No.: US 7,751,530 B2
(45) Date of Patent: Jul. 6, 2010

(54) HIGH FLUX X-RAY TARGET AND ASSEMBLY

(75) Inventors: Mandyam Sridhar, Rajamahalvilas (IN); Manoharan Venugopal, Bangalore (IN); Debasish Mishra, Bangalore (IN); Savio Sebastian, Bangalore (IN); Harith Vadari, Bangalore (IN); Mark Frontera, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/856,328

(22) Filed: Sep. 17, 2007

(65) Prior Publication Data

US 2009/0074145 A1 Mar. 19, 2009

(51) Int. Cl.
*H01J 35/26* (2006.01)
*H01J 35/28* (2006.01)

(52) U.S. Cl. ..... 378/126; 378/125; 378/131; 378/144

(58) Field of Classification Search ..... 378/126, 378/131
See application file for complete search history.

(56) References Cited

U.S. PATENT DOCUMENTS 1,997,676 A 4/1935 Catlin
2,926,270 A * 2/1960 Zunick ..... 378/126
3,398,307 A * 8/1968 Brown et al. ..... 378/126
3,836,805 A * 9/1974 Kok ..... 378/126
4,107,563 A * 8/1978 Oddell ..... 378/126
4,162,420 A * 7/1979 Grady ..... 378/126
4,399,551 A * 8/1983 Grady ..... 378/126
7,042,975 B2 * 5/2006 Heuscher ..... 378/8
7,305,063 B2 * 12/2007 Heuscher ..... 378/12
7,305,066 B2 * 12/2007 Ukita ..... 378/126
7,394,891 B2 * 7/2008 Sakabe ..... 378/126
2005/0207537 A1 * 9/2005 Ukita ..... 378/125
2009/0238328 A1 * 9/2009 Forthmann et al. ..... 378/14
2010/0027753 A1 * 2/2010 Venugpal et al. ..... 378/130

FOREIGN PATENT DOCUMENTS

DE 29622655 U1 1/1996
JP 2001351551 12/2001

* cited by examiner

*Primary Examiner*—Edward J Glick
*Assistant Examiner*—Thomas R Artman
(74) *Attorney, Agent, or Firm*—McNees Wallace & Nurick, LLC

(57) ABSTRACT

An X-ray tube anode assembly, an X-ray tube assembly and a method for heat management to an X-ray assembly having a movable X-ray target having a target surface. The anode assembly includes a drive member arranged and disposed to provide oscillatory motion to the target assembly and a target surface that is configured to remain at a substantially fixed distance from a cathode assembly during oscillatory motion.

23 Claims, 5 Drawing Sheets

HIGH FLUX X-RAY TARGET AND ASSEMBLY

FIELD OF THE INVENTION

This disclosure relates to an X-ray tube anode target assembly and, more particularly, to configuration and structures for controlling heat dissipation and structural loads for an X-ray tube anode target assembly.

BACKGROUND

Ordinarily an X-ray beam-generating device referred to as an X-ray tube comprises dual electrodes of an electrical circuit in an evacuated chamber or tube. One of the electrodes is electron emitter cathode which is positioned in the tube in spaced relationship to a target anode. Upon energization of the electrical circuit generates a stream or beam of electrons directed towards the target anode. This acceleration is generated from a high voltage differential between the anode and cathode that may range from 60-450 kV, which is a function of the imaging application. The electron stream is appropriately focused as a thin beam of very high velocity electrons striking the target anode surface. The anode surface ordinarily comprises a predetermined material, for example, a refractory metal so that the kinetic energy of the striking electrons against the target material is converted to electromagnetic waves of very high frequency, i.e. X-rays, which proceed from the target to be collimated and focused for penetration into an object usually for internal examination purposes, for example, industrial inspection procedures, healthcare imaging and treatment, or security imaging applications, food processing industries. Imaging applications include, but are not limited to, Radiography, CT, X-ray Diffraction with Cone and Fan beam x-ray fields.

Well-known primary refractory and non-refractory metals for the anode target surface area exposed to the impinging electron beam include copper (Cu), Fe, Ag, Cr, Co, tungsten (W), molybdenum (Mo), and their alloys for X-ray generation. In addition, the high velocity beam of electrons impinging the target surface generates extremely high and localized temperatures in the target structure accompanied by high internal stresses leading to deterioration and breakdown of the target structure. As a consequence, it has become a practice to utilize a rotating anode target generally comprising a shaft supported disk-like structure, one side or face of which is exposed to the electron beam from the thermionic emitter cathode. By means of target rotation, the impinged region of the target is continuously changing to avoid localized heat concentration and stresses and to better distribute the heating effects throughout the structure. Heating remains a major problem in X-ray anode target structures. In a high speed rotating target, heating must be kept within certain proscribed limits to control potentially destructive thermal stresses particularly in composite target structures, as well as to protect low friction, solid lubricated, high precision bearings that support the target.

Only about 1.0% of the energy of the impinging electron beam is converted to X-rays with the remainder appearing as heat, which must be rapidly dissipated from the target essentially by means of heat radiation. Accordingly, significant technological efforts are expended towards improving heat dissipation from X-ray anode target surfaces. For most rotating anode targets heat management must take place principally through radiation and a material with a high heat storage capacity. Stationary anode target body configurations or some complex rotating anode target configurations may be designed to have heat transfer primarily take place using conduction or convection from the target to the x-ray tube. Life of rotating x-ray targets are often gated by the complexities of rotation in a vacuum. Traditional x-ray target bearings are solid lubricated, which have relatively low life. Stationary targets do not have this life-limiting component, at the cost of lower performance.

Other rotation components, solid lubricated bearings, ferro-fluid seals, spiral-grooved liquid metal bearings, etc, all introduce manufacturing complexity and system cost.

What is needed is a high flux X-ray tube configuration that provides improved heat dissipation and includes components capable of maintaining an extended life, with a limited introduction of cost and manufacturing complexity.

SUMMARY OF THE DISCLOSURE

One aspect of the present disclosure includes an X-ray tube anode assembly having a movable X-ray target having a target surface. The anode assembly includes a drive member arranged and disposed to provide oscillatory motion to the target assembly and a target surface that is configured to remain at a substantially fixed distance from a cathode assembly during oscillatory motion.

Another aspect of the present disclosure includes an X-ray tube assembly including an envelope having at least a portion thereof substantially transparent to X-ray. The assembly also includes a cathode assembly, operatively positioned in the envelope with an anode assembly having a movable X-ray target having a target surface. The anode assembly includes a drive member arranged and disposed to provide oscillatory motion to the target assembly and a target surface that is configured to remain at a substantially fixed distance from a cathode assembly during oscillatory motion. This anode system may be tuned to allow the pivot to be driven at natural frequency, lowering the required drive power to obtain the desired oscillatory frequency.

Still another aspect of the present disclosure includes a method for providing heat management to an X-ray assembly. The method includes providing an X-ray tube having including an envelope having at least a portion thereof substantially transparent to X-ray. The assembly also includes a cathode assembly, operatively positioned in the envelope with an anode assembly having a movable X-ray target having a target surface. The anode assembly includes a drive member arranged and disposed to provide oscillatory motion to the target assembly and a target surface that is configured to remain at a substantially fixed distance from a cathode assembly during oscillation. The method further includes oscillating the anode assembly, wherein the target surface is configured to remain at a substantially fixed distance from the cathode assembly during the oscillating.

The position of the focal point along the surface of the target is varied, providing improved heat management, wherein the heat may be dissipated more easily. In addition, the increased dissipation permits the use of higher power and longer durations than are available with the use of a stationary anode arrangement. In addition, the anode has increased life over anodes that have a fixed focal point on the anode. The oscillatory motion provides longer life than solid lubricated bearings used in known rotating anode sources.

Additionally, the assembly will have reduced manufacturing complexity, and cost, in comparison to conventional rotational bearing arrangements.

The assembly of the present disclosure may allow multiple spots to be placed on a single target, in that each region will be thermally isolated from the neighboring spot, while maintaining the benefit of higher power through oscillatory motion from a single drive mechanism.

The assembly of the present disclosure may also allow for the introduction of oscillatory motion into an array of focal spots on a multi-spot anode source.

Embodiments of the present disclosure also allow the distribution of heat over a larger area of the anode target, through the oscillating motion, which reduces the peak temperature and maintains the temperature below the evaporation limit for the metal in the envelope, and reduces the temperature gradient between surface and substrate Other features and advantages of the present disclosure will be apparent from the following more detailed description of the preferred embodiment, taken in conjunction with the accompanying drawings which illustrate, by way of example, the principles of the disclosure.

BRIEF DESCRIPTION OF THE DRAWINGS

Wherever possible, the same reference numbers will be used throughout the drawings to refer to the same or like parts.

DETAILED DESCRIPTION

Figure 1:
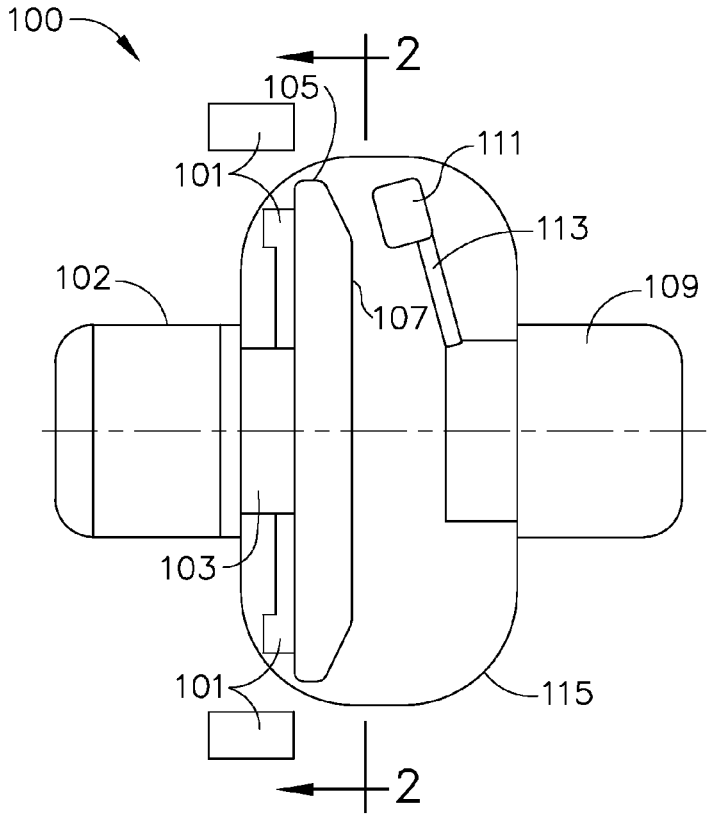
FIG. 1 shows an elevational side view of an X-ray tube assembly according to an embodiment of the present disclosure.

FIG. 1 is a schematic view of an X-ray tube 100 having an anode assembly and a cathode assembly, through thermionic or field-emission election generation, arranged in a manner that permits formation of X-rays, during tube operation. The anode assembly includes a fixture 102, oscillatory coupling 103, a drive assembly 101 and target 105. Fixture 102 includes a substantially stationary support, which is attached to a portion of the oscillatory coupling 103. A first portion of the oscillatory coupling 103 attached to the fixture remains stationary while a second portion of the oscillatory coupling 103, attached to the target 105, is permitted to oscillate. The drive assembly 101 includes an arrangement capable of providing oscillatory motion to the target 105. In the arrangement shown, the drive assembly 101 includes a magnetically driven motor arrangement, including fixed stator portions and movable rotor portions attached to the target 105 operably arranged to provide the oscillatory motion for the attached target 105. The present disclosure is not limited to the arrangement of drive assembly 101 shown and may include any arrangement capable of providing oscillatory motion to the target 105. By "oscillatory", "oscillation" and grammatical variations thereof, it is meant to include swaying motion to and fro, rotation or pivoting on an axis between two or more positions and/or motion including periodic changes in direction. The target 105 substrate, including the target focal surface 107 may include any material suitable for use as an anode target, such as, but not limited to copper (Cu), iron (Fe), silver (Ag), chromium (Cr), cobalt (Co), tungsten (W), molybdenum (Mo), and their alloys. For example, tungsten or molybdenum having additive refractory metal components, such as, tantalum, hafnium, zirconium and carbon may be utilized. The suitable materials may also include oxide dispersion strengthened molybdenum and molybdenum alloys, which may further include the addition of the addition of graphite to provide additional heat storage. Further still, suitable material may include tungsten alloys having added rhenium to improve ductility of tungsten, which may be added in small quantities (1 to 10 wt %).

The cathode assembly 109 comprises an electron emissive portion 111 mounted to a support 113. The disclosure is not limited to the arrangement shown, but may be any arrangement and/or geometry that permits the formation of an electron beam at the electron emissive portion 111. Conductors or other current supplying mechanism may be included in the cathode assembly 109 to supply heating current to a filament and/or conductor present in the cathode assembly for maintaining the cathode at ground or negative potential relative to the target 105 of the tube 100. An electron beam from the electron emissive portion 111 impinges upon target 105 at a focal point on the target focal surface 107 to produce X-radiation (see e.g., FIG. 6). The focal point may be a single point or an area having any suitable geometry corresponding to the electron emissions from the electron emissive potion 111. Additionally, the focal point may have movement introduced into the beam from electrostatic, magnetic or other steering method. In addition, the focal point may be of constant size and/or geometry or may be varied in size and/or geometry, as desired for the particular application. "X-ray", "X-radiation" and other grammatical variations as utilized herein mean electromagnetic radiation with a wavelength in the range of about 10 to 0.01 nanometers or other similar electromagnetic radiation. Heat is generated along the target focal surface 107 at the point of electron beam contact (i.e., the focal point). The target 105 is oscillated by drive assembly 101, which may include, but is not limited to, an induction or otherwise magnetically or mechanically driven drive mechanism. Suitable drive assemblies 101 may include, but are not limited to, voice-coil actuators or switched reluctance motors (SRM) drive. The drive assembly 101 may further include cams or other structures to convert rotational or other motion to oscillatory motion.

The oscillation provides movement of the target 105, such that the focal point within the target focal surface 107 provides a substantially constant X-ray emission, wherein the target 105 moves relative to the focal point. Specifically, the drive assembly 101 provides oscillatory motion to target 105 such that the focal point remains at a substantially fixed distance from the electron emissive portion 111 and/or the angle at which the electron beam impinges the target 105 remains substantially constant. The present disclosure is not limited to reflection based geometry for X-ray generation, but may include alternate configurations, such as targets 105 configured for transmission generated X-rays. The anode assembly and the cathode assembly 109 are housed in an envelope 115, which is under vacuum or other suitable atmosphere. One embodiment includes a portion of the drive assembly 101 (e.g. the stator portion) exterior to the envelope. At least a portion of the envelope 115, which acts as a window for the X-rays, is glass or other material substantially transparent to X-rays. The configuration of the envelope 115 may be any configuration suitable for providing the X-radiation to the desired locations and may be fabricated from conventionally utilized materials.

Figure 2:
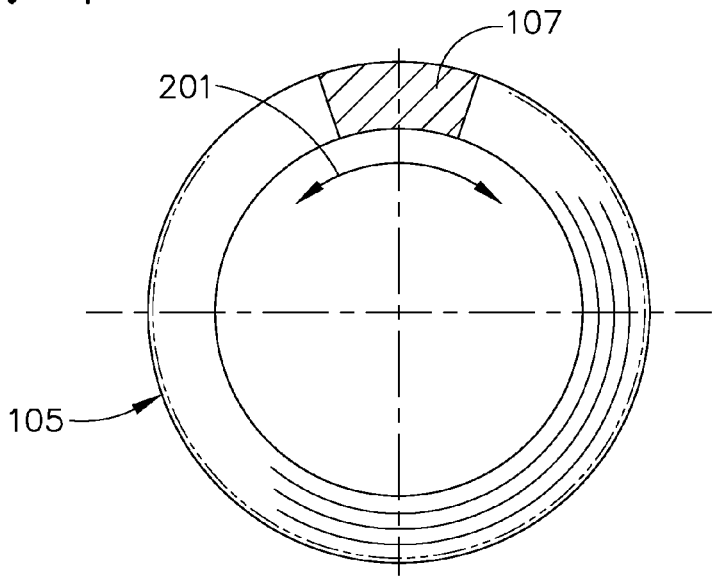
FIG. 2 shows a view of an anode assembly taken along line 2-2 of FIG. 1 according to an embodiment of the present disclosure.

FIG. 2 shows a view 2-2 taken from FIG. 1, wherein the target 105 is shown including the oscillatory motion 201. While the motion 201 is shown as a motion between equally spaced points along the target 105, the disclosure is not so limited and may include asymmetrical motion or motion with periodic changes in amplitude and/or position. The target focal surface 107 includes an area of target 105, which the focal point of the electron beam strikes, as the target 105 oscillates. The target focal surface 107 is not limited to the surface that the electron beam contacts, but includes the area surrounding the focal point. The target focal surface 107 preferably provides an aspect angle to which the electron beam impinges that is substantially constant and directs the X-radiation in the desired direction throughout the oscillatory motion 201 of the target 105. The target 105 is not limited to the geometry shown and may include segmented or otherwise non-circular geometry targets 105, for example, while not so limited, targets 105 may have a "butterfly" shape, or a multi-spot flat rectangle geometry. In addition, the target 105 and/or the X-ray assembly may be configured to alter the focal point and/or the target focal point surface 107 in the event that a newly exposable surface is desired, such as if the surface is damaged or otherwise unsuitable for continued use.

Figure 3:
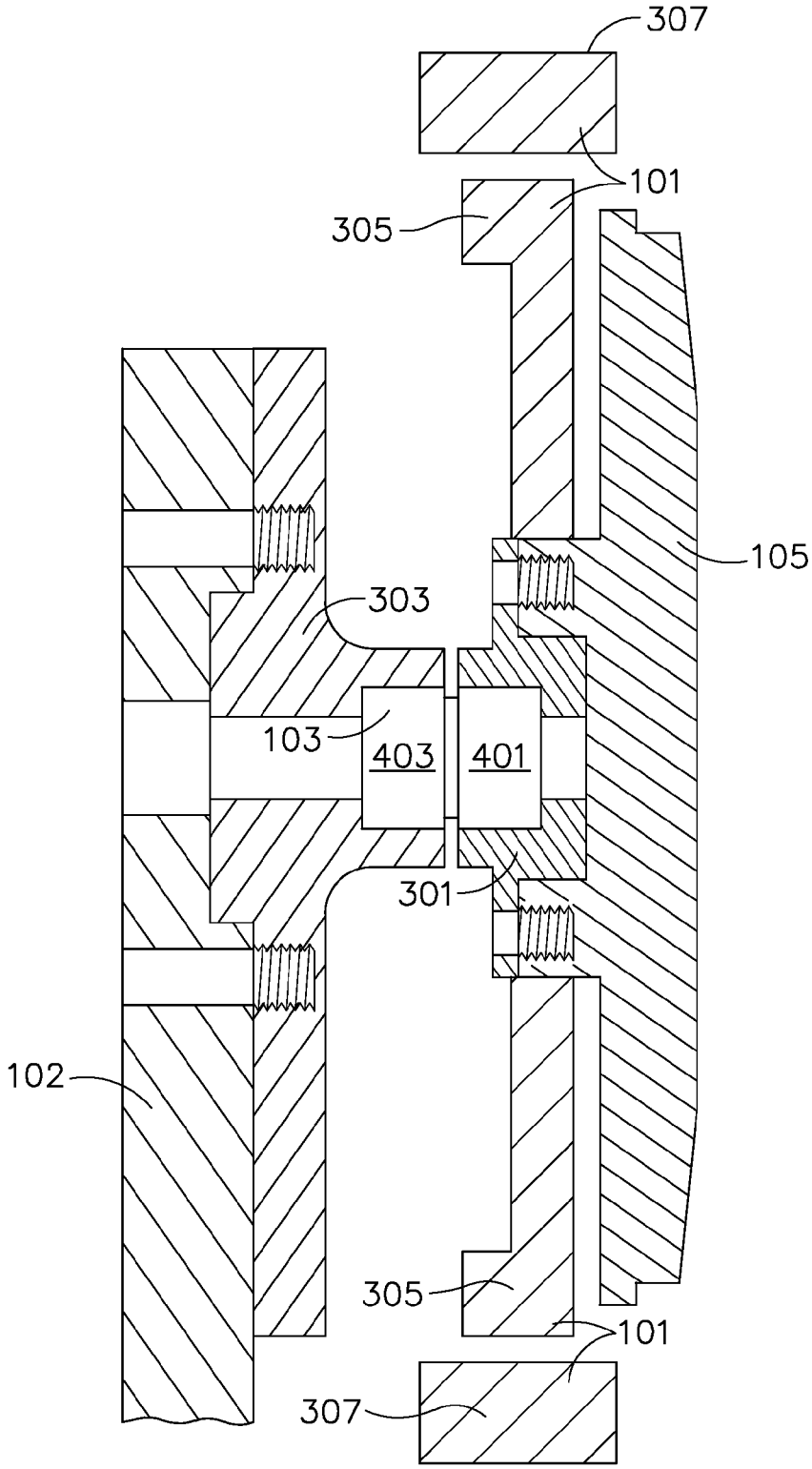
FIG. 3 shows an elevational sectional view of an anode assembly according to an embodiment of the present disclosure.

FIG. 3 shows an elevational cross-section of an anode assembly according to an embodiment of the present disclosure. In this embodiment, a target 105 is affixed to a coupling 301, which is connected to stem 303 by an oscillatory coupling 103. In particular, coupling 303 is attached to a first segment 401 of oscillatory coupling 103 (see e.g., FIG. 4). The stem 303 is attached to the fixture 102 or another stationary structure. Drive assembly 101 provides the target 105 with oscillatory motion 201. As shown, the drive assembly 101 includes a rotor portion 305 attached to the target and a stator portion 307 operably arranged with respect to the rotor portion 305. Specifically, the stator portion 307 is positioned such that induced magnetic fields within the stator portion 307 drive the rotor potion 305 and provide motion (i.e., oscillatory motion) thereto. One skilled in the art would also understand that this could oscillatory motion may also be provided utilizing bearing configurations. Stem 303 is attached to a second segment 403 of oscillatory coupling 103 (see e.g., FIG. 4), wherein the second segment 403 is substantially fixed, while the first segment 401 oscillates relative to the second segment 403. The oscillatory coupling 103 provides a spring-like back and forth oscillatory motion 201 between segments 401, 403 of the oscillatory coupling 103. The oscillatory coupling 103 provides a pivotable or otherwise movable connection that permits the oscillatory motion 201 of the target 105 via the drive assembly 101.

Figure 4:
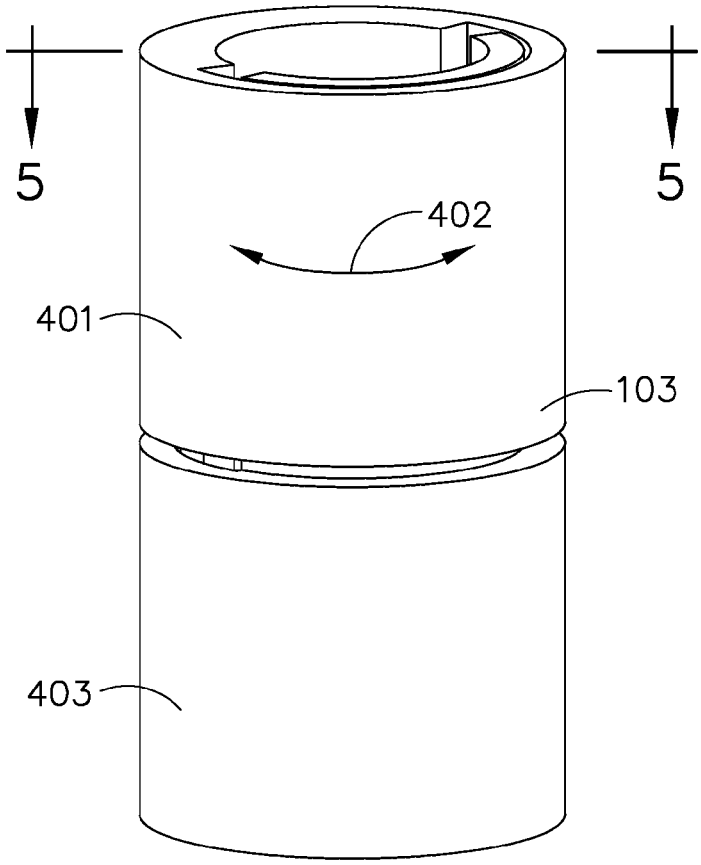
FIG. 4 shows an oscillatory coupling according to an embodiment of the present disclosure.
Figure 5:
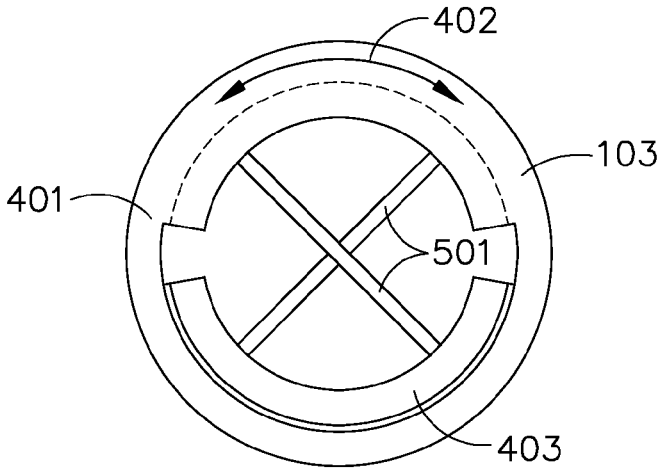
FIG. 5 shows a view of an anode assembly taken along line 5-5 of FIG. 4 according to an embodiment of the present disclosure.

FIG. 4 shows an oscillatory coupling 103 for use in an embodiment of the disclosure. The oscillatory coupling 103 includes a first segment 401 that rotates with respect to a second segment 403 by segment oscillation 402. During oscillation, the second segment 403 remains substantially stationary. In particular, the second segment 403 is attached to a fixture or other support that retards movement of the second segment 403, while first segment 401 is permitted to oscillate. FIG. 5 shows oscillatory coupling 103 taken along 5-5 of FIG. 4. The oscillatory coupling 103 provides oscillatory motion 402 by a coupling mechanism 501 between the first segment 401 and the second segment 403. The coupling mechanism 501 may be one or more spring or force providing or otherwise flexible devices that provide connection between segments 401, 403 and reciprocating motion between segments 401, 403. In the embodiment shown in FIGS. 3-5, a linear spring is utilized to provide flexing sufficient to provide oscillatory motion 201. The oscillatory coupling mechanism 501 may include linear springs selected to introduce motion that may be varied for desired frequency, angle and path radii.

Coupling mechanisms 501, for example, utilizing linear springs to provide oscillation, may have up to infinite life spans for a prescribed radial load and oscillating angle, which life spans are difficult or impossible in known rotary motion assemblies. During operation of X-ray tube 100, the drive assembly 101, which is configured to oscillate the target 105 in a manner that results in flexing of the coupling mechanism 501, which, permits motion of the first segment 401 (i.e. oscillation 402) with respect to the second segment 403. The oscillation of the first segment 401 provides target 105 with oscillatory motion 201 desirable for heat management.

The resultant oscillatory motion 201 provides a path along which the focal point travels. Since the position along the target 105 is varied, the heat generated by the impingement of the electrons on the target 105 is permitted to dissipate over a larger area. This dissipation of heat permits the use of higher power and longer durations than are available with the use of a stationary anode arrangement.

Figure 6:
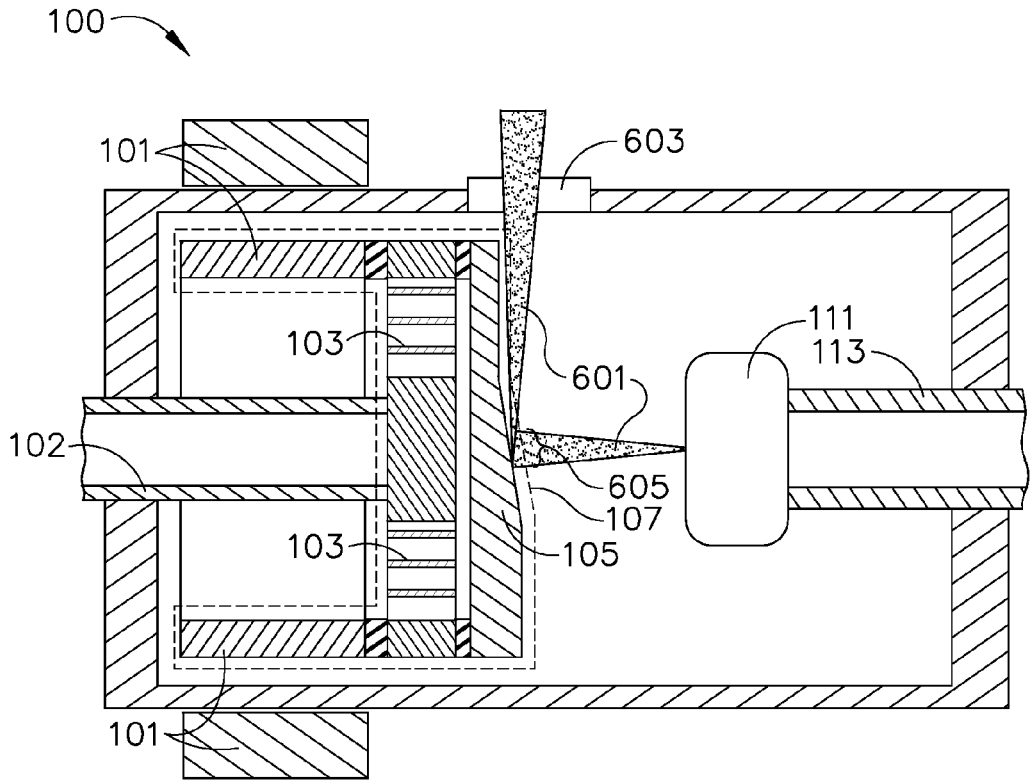
FIG. 6 shows an elevational sectional view of an X-ray tube assembly according to an embodiment of the present disclosure.

FIG. 6 shows a cross-section of an X-ray tube 100 according to another embodiment of the disclosure. As in the embodiment shown in FIG. 1, the X-ray tube 100 includes a cathode assembly 109 and an anode assembly. The anode assembly includes a target 105 attached to an oscillatory coupling 103. A portion of oscillatory coupling 103 (i.e. first segment 401, see FIG. 7) is attached to a drive assembly 101, which is configured to provide oscillatory motion to the target 105 by magnetic or other means. In FIG. 6, drive assembly 101 includes an arrangement of stator and rotor portions, as more fully described above with respect to FIG. 3. In addition, a portion of oscillatory coupling 103 (i.e. second segment 403, see FIG. 7) is attached to the fixture 102, which substantially prevents motion of a portion of oscillatory coupling 103 (i.e. second segment 403, see FIG. 7). The X-ray tube 100 operates by providing an electron beam 601 by heating or otherwise providing power to the electron emissive portion 111, wherein the beam 601 impinges on target focal surface 107 at focal point 605. The target focal surface 107, as shown in FIG. 6 is configured to provide a substantially constant angle of impingement by the electron beam 601, throughout the oscillatory motion 201. The beam 601 produces X-radiation by impingement on target 105, wherein the X-radiation is directed through window 603.

Figure 7:
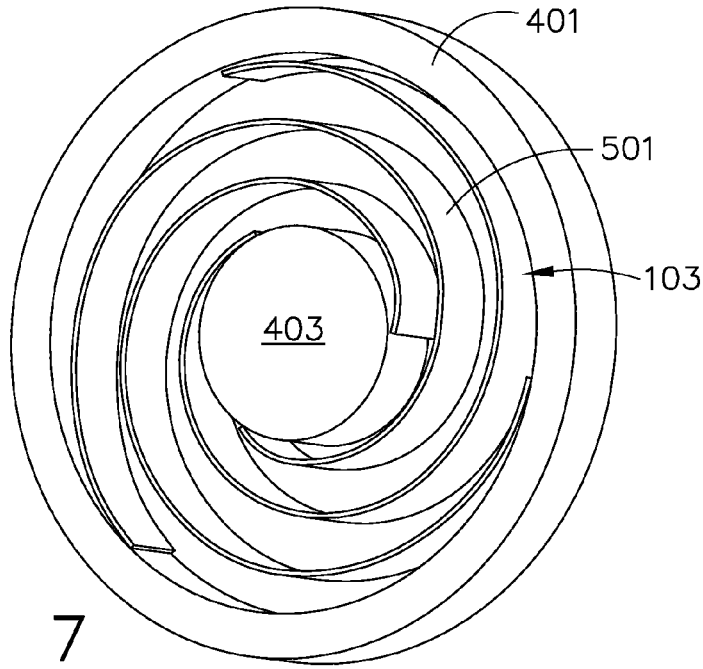
FIG. 7 shows an oscillatory coupling according to an embodiment of the present disclosure.

FIG. 7 shows an oscillatory coupling 103 for use in the embodiment shown in FIG. 6. The oscillatory coupling 103 includes a coupling mechanism 501 that connects the first segment 401 to the second segment 403 in a manner that permits relative motion (i.e., oscillatory motion 201) between the first segment 401 and the second segment 403. As in the coupling 103 shown and described in FIGS. 4 and 5, the first segment 401 may be attached to the drive assembly 101 in a manner that permits oscillatory motion 201 to the target 105. The drive assembly 101 rotates the target 105 where the first segment 401 flexes or otherwise moves the coupling mechanism 501 in a manner that results in oscillatory motion with respect to the second segment 403. In the embodiment shown in FIGS. 6-7, the coupling mechanism 501 includes a spiral spring arrangement. Dwell time and delay time may be reduced or eliminated when the X-ray tube 100 utilizes coupling mechanism 501 shown in FIGS. 6-7. The first segment 401 provides the target 105 with oscillatory motion 201, wherein the target focal surface 107 provides substantially constant X-ray production throughout the motion of the target 105.

The present disclosure is not limited to oscillation provided through the use of a oscillatory coupling 103, but also includes direct actuation of the target 105 in a oscillatory motion 201. For example, the target 105 may be affixed to a drive assembly 101, wherein the drive assembly 101 provides reciprocating rotation or oscillation of the target 105, such that the target focal surface 107 provides substantially constant production of X-rays from the electron beam 601. Other configurations, such as a linear or elongated target 105 having an oscillated target focal surface 107 actuated by a linear actuator or other linear motion device. Further a cam or similar device may be utilized to translate rotational or other motion to oscillatory motion. In addition, the present disclosure is not limited to the geometry of the targets shown and may include target geometries that are asymmetrical or other non-circular arrangements. Further still, the present disclosure is not limited to a single focal point and may include multiple focal points.

Figure 8:
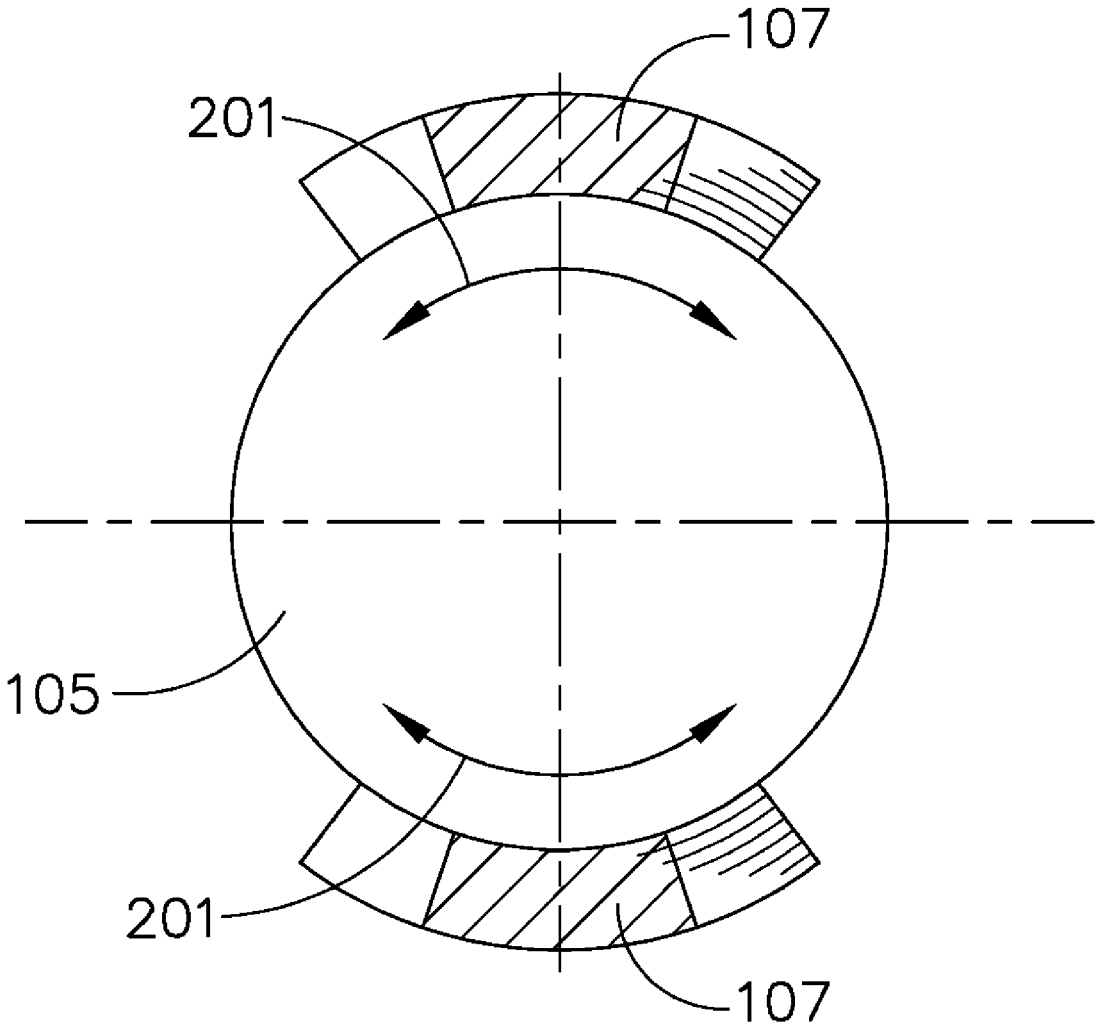
FIG. 8 shows a view of target according to an embodiment of the present disclosure.

As shown in FIG. 8, the target 105 may non-circular geometries. The target may also include a plurality of target focal surfaces 107 corresponding to multiple focal points. The target 105 oscillates in direction 201 during operation. Oscillation of the target is provided by a drive assembly 101, as described more fully above. The geometry of the target may vary and may include the geometry shown in FIG. 8 with a single target focal surface 107 or a plurality of target focal surfaces. In addition, the reduction of size and mass of the target permits the utilization of smaller drive assemblies 101 and reduced wear on components supporting the oscillating target 105.

EXAMPLES

An example finite element analysis comparing a stationary target to a oscillating target with +/−9.5° degree oscillation at 10 Hz on a 78 mm radius arc shows an entitlement of 2.3× power increase while maintaining thermal limits of track surface temperature <2400° C. and copper temperatures of <300° C. One skilled in the art would note that the power increase is gated by the optimization of the track oscillation angle, oscillation frequency and focal spot path radii. In addition, the power increase includes varied system size, cost and expected life span. The oscillatory motion introduces transient temperature fields on the surface of the anode target that will have a peak dwell time of the focal beam at the end of the oscillation path. The ends of the oscillation path determine the thermal limit of the track surface.

While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

The invention claimed is:

1. An X-ray tube anode assembly comprising:

a movable X-ray target having a target surface;

a drive member arranged and disposed to provide oscillatory motion to the movable X-ray target; and an oscillatory coupling attached to the movable X-ray target, the oscillatory coupling including a first segment and a second segment, the first segment being configured to rotate with respect to the second segment by a flexible coupling mechanism connecting the first segment and the second segment to permit the drive member to oscillate the movable X-ray target;

wherein the target surface is configured to remain at a substantially fixed distance from a cathode assembly during oscillatory motion, the oscillatory motion including motion selected from the group consisting of swaying motion to and fro, pivoting motion on an axis between two or more positions, and combinations thereof; and wherein the drive member comprises a magnetically driven motor arrangement comprising a fixed stator portion and a movable rotor portion attached to the movable X-ray target.

2. The anode assembly of claim 1, wherein the cathode assembly and target surface are configured to provide a single focal point.

3. The anode assembly of claim 1, wherein the cathode assembly and target surface are configured to provide a multiple focal points.

4. The anode assembly of claim 1, wherein the target surface is configured to provide a reflection X-ray generation.

5. The anode assembly of claim 1, wherein the target surface is configured to provide a transmission X-ray generation.

6. The anode assembly of claim 1, wherein the oscillatory coupling is between the drive member and the target.

7. The anode assembly of claim 6, wherein the oscillatory coupling includes a substantially linear coupling.

8. The anode assembly of claim 6, wherein the oscillatory coupling includes a spiral coupling.

9. The anode assembly of claim 1, wherein the target is arranged at an angle to the cathode assembly, the angle remaining substantially constant during oscillatory motion.

10. Anode assembly of claim 1, wherein the target has two or more segments each comprising the target surface.

11. Anode assembly of claim 1, wherein the assembly is configured to be radiatively, conductively or convectively cooled.

12. An X-ray tube assembly comprising:

an envelope having at least a portion thereof substantially transparent to X-ray;

a cathode assembly, operatively positioned in the envelope with an anode assembly comprising:

a movable X-ray target having a target surface;

a drive member arranged and disposed to provide oscillatory motion to the movable X-ray target;

an oscillatory coupling attached to the movable X-ray target, the oscillatory coupling including a first segment and a second segment, the first segment being configured to rotate with respect the second segment by a flexible coupling mechanism connecting the first segment and the second segment to permit the drive member to oscillate the movable X-ray target; and wherein the target surface is configured to remain at a substantially fixed distance from the cathode assembly during oscillatory motion, the oscillatory motion including motion selected from the group consisting of swaying motion to and fro, pivoting motion on an axis between two or more positions, and combinations thereof; and wherein the drive member comprises a magnetically driven motor arrangement comprising a fixed stator portion and a movable rotor portion attached to the movable X-ray target.

13. The X-ray tube assembly of claim 12, wherein the cathode assembly and target surface are configured to provide a single focal point.

14. The X-ray tube assembly of claim 12, wherein the cathode assembly and target surface are configured to provide a multiple focal points.

15. The X-ray tube assembly of claim 12, wherein the target surface is configured to provide a reflection X-ray generation.

16. The X-ray tube assembly of claim 12, wherein the target surface is configured to provide a transmission X-ray generation.

17. The X-ray tube assembly of claim 12, wherein the oscillatory coupling is between the drive member and the target.

18. The X-ray tube assembly of claim 17, wherein the oscillatory coupling includes a substantially linear coupling.

19. The X-ray tube assembly of claim 17, wherein the oscillatory coupling includes a spiral coupling.

20. The X-ray tube assembly of claim 12, wherein the target is arranged at an angle to the cathode assembly, the angle remaining substantially constant during oscillatory motion.

21. A method for providing heat management to an X-ray assembly comprising:

providing an X-ray tube assembly having:

an envelope having at least a portion thereof substantially transparent to X-ray;

a cathode assembly, operatively positioned in the envelope;

an anode assembly comprising:

a movable X-ray target having a target surface;

a drive member arranged and disposed to provide oscillatory motion to the movable X-ray target;

an oscillatory coupling attached to the movable X-ray target, the oscillatory coupling including a first segment and a second segment, the first segment being configured to rotate with respect to the second segment by a flexible coupling mechanism connecting the first segment and the second segment to permit the drive member to oscillate the movable X-ray target; and oscillating the anode assembly, wherein the target surface is configured to remain at a substantially fixed distance from the cathode assembly during the oscillating, the oscillating including motion selected from the group consisting of swaying motion to and fro, pivoting motion on an axis between two or more positions, and combinations thereof; and wherein the drive member comprises a magnetically driven motor arrangement comprising a fixed stator portion and a movable rotor portion attached to the movable X-ray target.

22. The method of claim 21, wherein the oscillatory coupling is between the drive member and the target.

23. The method of claim 21, further maintaining a substantially constant angle between the target surface and the cathode assembly during oscillatory motion.

* * * * *